US006705015B2

(12) United States Patent
Stagi

(10) Patent No.: US 6,705,015 B2
(45) Date of Patent: Mar. 16, 2004

(54) HAIRCUTTING TOOL WITH SUPERIMPOSED BLADES

(76) Inventor: Mario Stagi, 6 Via, Carducci, Camaiore (Lucca) (IT), 55041

( * ) Notice: Subject to any disclaimer, the term of this patent is extended or adjusted under 35 U.S.C. 154(b) by 0 days.

(21) Appl. No.: 09/953,304

(22) Filed: Sep. 17, 2001

(65) Prior Publication Data

US 2002/0035787 A1 Mar. 28, 2002

(30) Foreign Application Priority Data

Sep. 28, 2000 (IT) ..... PI20000035 U

(51) Int. Cl.[7] ..... B26B 13/00
(52) U.S. Cl. ..... 30/227; 226/253
(58) Field of Search ..... 30/226, 227, 253, 30/256, 244, 245, 249, 120, 255, 271; D8/57, 58

(56) References Cited

U.S. PATENT DOCUMENTS 681,327 A * 8/1901 Klever, Jr. ..... 30/226
1,296,660 A * 3/1919 Hayden
2,505,705 A * 4/1950 Cohn ..... 30/253
3,978,584 A * 9/1976 Mayer ..... 30/256
D251,232 S * 3/1979 Yamamoto ..... D8/57
5,964,038 A * 10/1999 DeVito ..... 30/226

FOREIGN PATENT DOCUMENTS

| | | | |
|---|---|---|---|
| DE | 31 34 308 | A1 | 3/1983 |
| DE | 195 04 149 | C1 | 10/1996 |
| DE | 196 13 052 | A1 | 10/1997 |
| EP | 0 940 231 | A1 | 9/1999 |
| EP | 0 943 403 | A1 | 9/1999 |
| FR | 2 704 797 | A1 | 11/1994 |
| JP | 2000-300865 | | 10/2000 |

* cited by examiner

*Primary Examiner*—Hwei-Siu Payer
(74) *Attorney, Agent, or Firm*—Browdy and Neimark, P.L.L.C.

(57) ABSTRACT

A haircutting tool comprising in which the cutting elements, extending from grip members (6, 8), coaxially thereto, comprise at least one V-shaped cutting front (F) defined by at least one couple of outer blades (2, 4), at least one of the outer blades (2, 4) being pivotable with respect to the grip members (6, 8). Driving apparatus (11) for driving the at least one outer pivotable blade fitted to be operated in order to adjust the angle of the at least one V-shaped cutting front (F).

11 Claims, 1 Drawing Sheet

HAIRCUTTING TOOL WITH SUPERIMPOSED BLADES

FIELD OF THE INVENTION

The present invention relates to the field of the professional equipment for haircutting, and namely it refers to a new type of cutting tool.

BACKGROUND OF THE INVENTION

Many cutting tools and methods are known, used by hairdressers in their professional practice. The choice of a particular tool and/or cutting technique depends on the type of haircut one wishes to obtain, and also on the skills and inclinations of the individual hairdresser.

The most traditional tools are the common scissors, with two blades having straight cutting edges or provided with variously shaped and sized teeth. In use, the typical cutting action provides that the operator seizes and stretches a tuft of hair with two fingers, while the other hand, holding the scissors, cuts the tuft by closing the two blades. If the scissors have straight cutting edges, the cut of the tuft will be clear and uniform. On the contrary, if the edges are toothed, only a part of the tuft, i.e. that which are affected by the contact with the teeth, will be cut.

The razor is another tool that is widely used by hairdressers. In its conventional configuration, the razor has a single blade, of which the edge is remarkably sharper than those of the scissors. The razor makes it possible to perform the technique for obtaining the so-called "layered tuft". According to such cutting technique, the operator drives the razor axially, at the same time suitably adjusting the radial friction between the blade and the tuft. In this way, by exerting a stronger friction in the initial phase of the cutting movement and a weaker one in the final phase, it is possible to obtain a tuft in which some hairs are remarkably shorter than others, thus accomplishing particular hairstyles. This result can not be obtained by using the scissors, with which the cut is always clear and outlined according to a fixed geometry and as a consequence the operator can not thin the tuft out variably—as mentioned above—unless innumerable subsequent cuts are carried out.

Nevertheless, the use of the razor involves some significant drawbacks. In particular, it is very difficult, especially for inexperienced operators, to have a precise control of the angle between the edge of the blade and the axis of the tuft, as a function of the effect one wishes to achieve. Namely, it is very hard for the operator to keep said angle constant irrespective of the variation of the part of the hair on which he/she is working, as required in many circumstances.

Besides, mainly for the defective handiness of the tool, it is troublesome to accurately adjust the radial friction on the tuft, as a function of the specific result to be obtained. For the same reason, the cutting operations are relatively tiring and time consuming. On the other hand, this latter drawback is also due to the poor productivity of the tool, i.e. the small amount of hair that is affected by each cutting movement.

Even disregarding the above-mentioned drawbacks, the following problem—intrinsically related to the cutting action performed by the razor—is probably even more relevant. In fact, when the blade of the razor shifts as described above, the surface of the hairs is extensively peeled, and as a result the hairs are devitalized and made dull. This entails both esthetical and medical negative consequences.

According to the above explanations, it will be actually impossible to make the tuft jagged, that is to give the relevant hairs a length that varies in a completely random way. This because with the razor the tuft is regularly thinned out, i.e. hairs linearly become longer moving along the axis of the tuft.

SUMMARY OF THE INVENTION

The main object of the present invention is to overcome such drawbacks, by providing a haircutting tool which, thanks to an original configuration of its components, permits to carry out the layered cutting technique in an effective and precise way, with a better control of the cutting action and with increased comfort and operation quickness.

A particular object of the present invention is to provide a tool of the above-mentioned type with which jagged tuft can be obtained, according to an effectiveness which is unachievable by the currently available tools.

Such objects are accomplished with the haircutting tool according to the present invention, comprising grip means and cutting means extending from said grip means, coaxially thereto, said cutting means comprising at least one V-shaped cutting front defined by at least one couple of outer blades, at least one of said outer blades being pivotable with respect to the grip means, means for driving said at least one outer pivotable blade being also provided, said driving means being fit to be operated in order to adjust the angle of said at least one V-shaped cutting front.

BRIEF DESCRIPTION OF THE DRAWINGS

Features and advantages of the haircutting tool according to the present invention will be made clearer hereinafter with the following description of embodiments thereof, made by way of example and not limitative, with reference to the attached drawings in which.

DETAILED DESCRIPTION OF THE PREFERRED EMBODIMENTS

Figure 3:
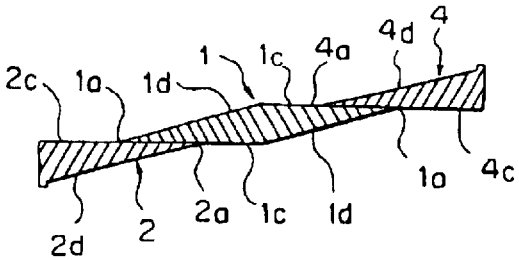
FIG. 3 is a cross-section of the tool taken along lines III—III of FIG. 1.

With reference to figures from 1 to 3, the tool according to the invention, in a first embodiment, comprises a central blade 1 shaped as a isosceles triangle, with two skew cutting edges 1*a*, straight and very sharp, symmetrically departing from a rounded tip 1*b*. The cross-section of blade 1 is outlined according to a parallelogram (as clearly shown in FIG. 3), defined by two mutually opposite shoulder faces 1*c*, and two mutually opposite sharpening faces 1*d*, cutting edges 1*a* being generated by a shoulder face 1*c* and a sharpening face 1*d* consecutive to each other.

Figure 2:
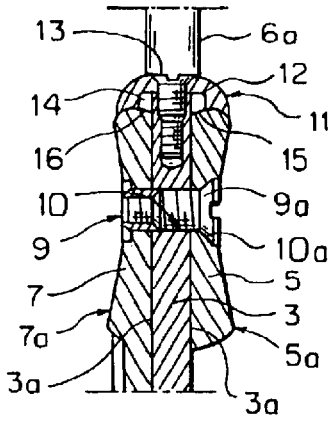
FIG. 2 is a cross-section of the tool taken along lines II—II of FIG. 1.

The end which is opposite to that forming tip 1*b* of central blade 1 is integrally connected to a foot, preferably—as in the depicted example—having the shape of a disk 3, of which the bases 3*a*, shown in FIG. 2, are coplanar to respective shoulder faces 1*c* of blade 1 itself. A grip arm 6 projects from the side surface 3*b* of disk 3, integrally as well and in an opposite direction with respect to blade 1. The free end of arm 6 forms a ring 8 substantially coplanar to disk 3. More precisely, arm 6 comprises a root 6*a* projecting from disk 3 in a substantially tangential direction, and proceeds with a curved stem 6*b* which tangentially joins ring 8, the latter being substantially lined-up with central blade 1.

Figure 1:
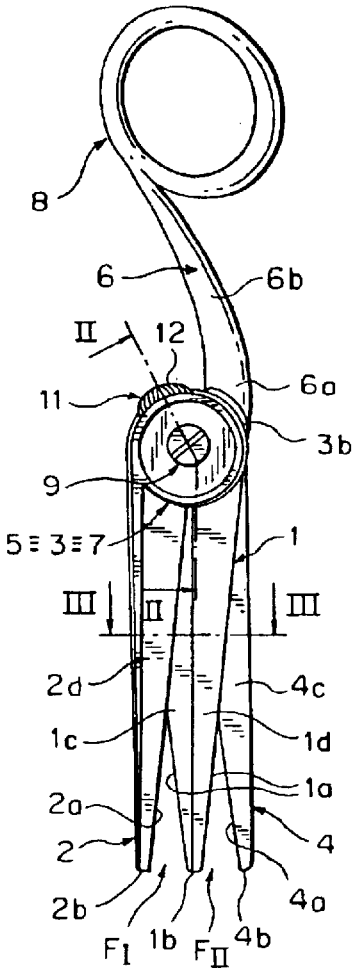
FIG. 1 shows a side view of a first embodiment of the tool according to the invention.

Two outer blades 2, 4 are placed on respective shoulder faces 1*c* of central blade 1 and are supported by disk 3 via further disks 5 and 7, according to what will be made clearer hereinafter. Outer blades 2, 4 have a triangular shape which substantially corresponds to a half of the central blade 1, with respective sharp edges 2*a*, 4*a*, opposite to each other and symmetrically converging from rounded tips 2*b*, 4*b* towards the axis of central blade 1. In this way, a couple of V-shaped cutting fronts, indicated at $F_I$ and $F_{II}$ in FIG. 1, are defined by edges 2*a*, 4*a* in cooperation with the two edges 1*a* of blade 1.

In greater detail, outer blades 2, 4 have each a triangular cross-section, formed by shoulder faces 2*c*, 4*c*, adjacent to corresponding shoulder faces 1*c* of central blade 1 and by oblique sharpening faces 2*d*, 4*d* which, joining shoulder faces 2*c*, 4*c* generate cutting edges 2*a*, 4*a*.

As mentioned, the two outer blades 2, 4 have respective disk-shaped foots 5 and 7, corresponding to disk 3 of central blade 1 and connected thereto on respective bases 3*a*. As shown in particular in FIG. 2, the mutual connection between the three disks 3, 5 and 7 is carried out via a screw 9, secured within a seat 10 axially formed therein. Seat 10 is screwed in correspondence to one of the outer disks, in the example disk 7, and has a flared portion 10*a* on the other outer disk 5, for the axial abutment of a head 9*a* of screw 9. In correspondence to central disk 3, screw 9 and seat 10 are coupled with a close running fit.

Thanks to the above described configuration, the two outer disks 5 and 7, and consequently the two outer blades 2 and 4, if operated with a certain strength, pivot with respect to central blade 1 about the common axis of the three superimposed disks, thus enlarging or narrowing the angle of cutting fronts $F_I$ and $F_{II}$. Such operation is driven—in a coordinate manner for the two outer blades 2, 4—by an adjustment mechanism 11, shown in FIG. 2 as well.

Mechanism 11 comprises a revolving operation crown 12, radially projecting from central disk 3 and supported thereby via a screw 13. Crown 12 coaxially bears a cone-shaped gear 14 which, engaging with complementary cone-shaped gears 15 and 16 formed in outer disks 5 and 7 respectively, so that the rotation of the crown 12 about its own axis drives the rotation of the two outer blades 2, 4 about the common axis of the three superimposed disks.

In use, the tool is gripped by the operator by inserting the forefinger or the middle finger of a hand within ring 8, and simultaneously placing the tip of the thumb on the outer face of one of the outer disk. In order to provide an easier and safer support to the fingertip, said faces preferably form respective cavities 5*a*, 7*a*, as in the depicted embodiment (see FIG. 2).

The cutting operation which can be accomplished in this way is substantially analogous to that according to the layered technique carried out by means of a common razor. However, in this case a fundamental advantage consists in the fact that, after a suitable preliminary adjustment of the angle of the cutting fronts $F_I$ and $F_{II}$, it is possible to effectively control the angle with which the hair tuft is affected by the cutting edges, keeping this angle constant, when required, irrespective of the variation of the part of the hair on which the operator is working.

In greater detail, a typical cutting procedure which can be carried out with the tool provides that, after adjusting and fixing the angle of the cutting fronts, a first tuft to be cut is chosen. This tuft is stretched with the fingers of the free hand. Then, the tuft is struck by means of the tool with quick and repeated cutting movements all around and along the tuft itself. Said movements are always guided from above, normally and/or obliquely with respect to the axis of the tuft.

After operation on a first tuft, a subsequent, closely higher one is picked and superimposed to the first, which is taken as a reference for the subsequent cutting action. Thanks to such technique, repeated for a number of subsequent tufts, one can make all the parts of the hair mutually proportioned and harmonized, in a much more easy way than with the procedure according to known techniques.

When driven towards the end of the tuft, the tool creates a number of pointed portions which, together with similar portions of the tufts which were previously cut, result in a jagged profile, while not damaging the surface of the hairs. Thus, the hair will be stably modeled according to the most various aesthetic needs, for obtaining a straight and compact hair dress or a voluminous one, the tufts sustaining each other via the pointed portions generated by the tool. Moreover, jagged outlines will be created with the object of obtaining particularly dynamic and fanciful dresses, of which the young customers are especially fond of.

As to the adjustment of the angle according to the specific cutting needs, in order to ensure a suitable adaptability of the tool it is sufficient that the gearing between crown 12 and outer disks 5, 7 is fit to control a rotation of the two outer blades 2, 4 of about 10°.

Besides, the ease and quickness of the cutting operation is assisted by the comfort of the grip, and by the fact that two distinct V-shaped cutting fronts are at work in a single cutting movement. However, this latter aspect does not imply an essential feature of the invention, since, in order to comply with particular handiness and precision requirements, it is possible to benefit from an embodiment which provides a single V-shaped cutting front.

Figure 4:
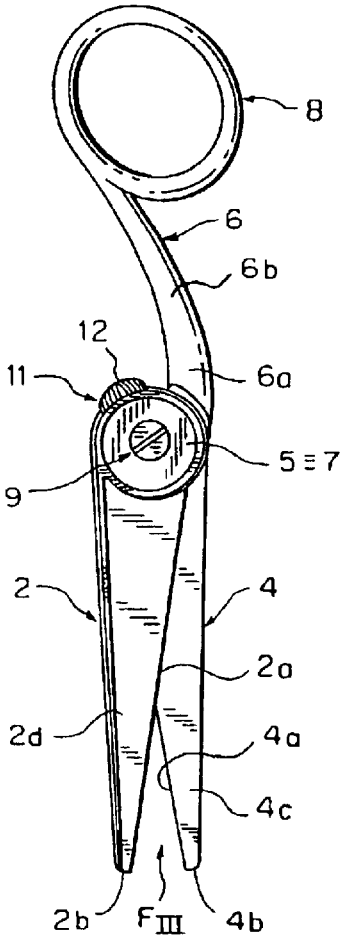
FIG. 4 is a side view of a second embodiment of the tool according to the invention.

Such an embodiment is shown in FIG. 4, in which parts corresponding to those of the first embodiment are indicated at the same reference numerals. In the depicted example, basically, central blade 1 and relevant disc 3 are not present, and the two outer blades 2, 4 define with respective edges 2*a*, 4*a* and a single V-shaped cutting front $F_{III}$, said blades directly contacting each other via respective shoulder faces. Grip arm 6 projects from one of the outer disks, namely disk 7, which also supports driving mechanism 11 with operation crown 12.

Therefore, in this case an outer blade 4 is integral to the grip, and mechanism 11 drives the other outer blade 2, so that the latter can pivot adjustably. A substantially analogous result can be achieved if disk 3 is maintained as a support for mechanism 11. The latter, as in the first embodiment, will drive both outer blades 2, 4, which contact each other due to the absence of central blade 1.

On the other hand, in a still different embodiment of the invention a tool is provided in which the stable central blade is a multiple one, i.e. a blade which, by means of two supplementary inwards cutting edges, forms a central V-shaped cutting front, having an unchanging angle, in addition to the two variable-angle cutting fronts generated by the same blade in cooperation with the adjustable outer blades. Such a tool will be useful for those cutting operations in which the maximum productivity is required.

Other variations and/or modifications can be brought to the haircutting tool with superimposed blades according to the present invention, without departing from the scope of the invention itself. Namely, the mechanism for adjusting the angle of the outer blades may be different from the one described above, provided that it can perform the same function. In an analogous manner, the grip of the tool may be shaped differently.

What is claimed is:

1. A haircutting tool comprising grip means (6, 8) and cutting means projecting away from said grip means, coaxially thereto, said cutting means comprising at least one V-shaped cutting front (F) defined by at least one pair of outer blades (2, 4), at least one of said outer blades (2, 4) being pivotable with respect to said grip means (6, 8), means (11) for driving said at least one outer pivotable blade (2, 4) prior to a haircutting operation being also provided, said driving means (11) being fit to be operated in order to adjust the angle of said at least one V-shaped cutting front (F);

wherein said pair of outer blades (2, 4) comprise, a first blade (4) which is integrally fixed to said grip means (6, 8) and a second blade which is pivotally supported by said first blade (4), said first blade and said second blade (2, 4) mutually contacting via respective shoulder faces (2*c*, 4*c*) forming respective cutting edges (2*a*, 4*a*), whereby a single V-shaped cutting front ($F_{III}$) is defined, said driving means (11) being associated with the first blade (4) for controlling the second blade (2), and wherein each of said pair of outer blades (2, 4) integrally project from a disc-shaped foot (5, 7), mutually superimposed, said pair of outer blades being respectively engaged via each said disc-shaped foot thereof.

2. A tool according to claim 1, wherein the pair of outer blades (2, 4), are both pivotally hinged to said grip means (6, 8), and controlled by said driving means (11).

3. The tool according to claim 2, wherein a central blade (1) integrally projects from said grip means (6, 8), said central blade (1) comprising a pair of opposite shoulder faces (1*c*) forming respective cutting edges (1*a*), said shoulder faces (1*c*) respectively contacting shoulder faces (2*c*, 4*c*) of said outer blades (2, 4), forming respective cutting edges (2*a*, 4*a*), whereby two V-shaped cutting fronts ($F_I$, $F_{II}$) are defined.

4. The tool according to claim 3, wherein each of said pair of outer blades (1, 2, 4) and said central blade integrally project from a disc-shaped foot (3, 5, 7), mutually superimposed, said pair of outer blades and said central blade being respectively engaged via each said disc-shaped foot thereof.

5. The tool according to claim 4, wherein said grip means comprise an arm (6) having a root (6*a*) tangentially projecting from one of said disc-shaped feet and a curved stem (6*b*) ending in a ring (8) which is substantially coplanar to the disc-shaped foot thereof, said ring and said disc-shaped foot thereof being lined-up according to a central axis of the tool.

6. The tool according to claim 5, wherein a cavity (5*a*, 7*a*) is formed in an outer face of at least one of said disc-shaped feet (5, 7) of the pair of outer blades, in order to assist the grip of the tool.

7. The tool according to claim 4, wherein said driving means (11) comprise a revolving crown (12), radially projecting from one said disc-shaped foot (3, 5, 7) and engaging via gear means (14, 16) with at least one of said pair of outer blades (2, 4) in order to control rotation thereof.

8. The tool according to claim 7, wherein said gear means (14, 16) are arranged in order to control the coordinate rotation of said pair of outer blades (2, 4).

9. The tool according to claim 1, in wherein said grip means comprise an arm (6) having a root (6*a*) tangentially projecting from one of said disc-shaped feet and a curved stem (6*b*) ending in a ring (8) which is substantially coplanar to the respective disc-shaped foot, said ring and said disc-shaped foot thereof being lined-up according to a central axis of the tool.

10. The tool according to claim 9, wherein a cavity (5*a*, 7*a*) is formed in an outer face of at least one of said disc-shaped feet of the pair of outer blades (5, 7), in order to assist the grip of the tool.

11. The tool according to claim 1, wherein said driving means (11) comprise a revolving crown (12), radially projecting from one of said disc-shaped feet (3, 5, 7) and engaging via gear means (14, 16) with at least one of said pair of outer blades (2, 4) in order to control rotation thereof.

* * * * *